United States Patent [19]

Foster

[11] Patent Number: 4,867,645

[45] Date of Patent: Sep. 19, 1989

[54] DOUBLE DIAPHRAGM PRESSURE SWITCH FOR A WELL WATER SYSTEM

[76] Inventor: Bailey G. Foster, P.O. Box 271, Sonoita, Ariz. 85637

[21] Appl. No.: 242,490

[22] Filed: Sep. 12, 1988

[51] Int. Cl.[4] ..... F04B 49/00

[52] U.S. Cl. ..... 417/38; 200/83 J; 200/83 Y

[58] Field of Search ..... 417/38; 200/83 J, 83 Y

[56] References Cited

U.S. PATENT DOCUMENTS

| | | | |
|---|---|---|---|
| 2,777,028 | 1/1958 | Kendall et al. | 200/83 J |
| 3,359,386 | 12/1967 | Howard | 200/83 Y |
| 3,784,772 | 1/1974 | Nelson | 200/83 Y |
| 4,024,887 | 5/1977 | McGregor | 137/386 |
| 4,207,030 | 6/1980 | Pearson | 417/38 |

*Primary Examiner*—Carlton R. Croyle
*Assistant Examiner*—D. Scheuermann

[57] ABSTRACT

A switch mechanism for controlling a motor that runs a well pump. Water line pressure acts on a diaphragm to pressurize an air chamber that communicates with a pressure switch. The switch components are isolated from the water line (by the air chamber), to minimize the possiblity of switch failure due to ice formation (winter time operations) or corrosion.

1 Claim, 1 Drawing Sheet

DOUBLE DIAPHRAGM PRESSURE SWITCH FOR A WELL WATER SYSTEM

BACKGROUND OF THE INVENTION

In some outdoor water well systems a hollow tank is connected into the line leading from the pump to the various water outlets in the water system. The tank fills up to a level that will maintain a relatively constant water pressure in the line. In this way the pump is not required to have a capacity as large as the maximum water usage rate (all outlets opened at the same time). During temporary periods of high water usage the tank can supply part of the needed water to the open outlets while maintaining a satisfactory pressure in the system.

Commonly, the pump motor is controlled by a pressure switch that responds to changes in line pressure, to turn the motor on or off, according as the line pressure falls below or exceeds a predetermined pressure setting. The line pressure maintains a fairly constant level in the tank, so that the tank is always assured of having enough water to meet any temporary high demand situation.

In conventional systems the pressure switch is arranged directly in the water line. During winter operations it is possible for ice to form in the switch or switch actuator, thereby causing a switch malfunction. Water leakage into the switch can also cause a malfunction. Some switch parts in direct contact with the water can corrode after extended service, thereby requiring switch replacement.

SUMMARY OF THE INVENTION

My invention relates to a mechanism for isolating the pressure switch from direct contact with the water in the line. The isolation mechanism preferably comprises a small housing having a flexible diaphragm therein that subdivides the housing into an air chamber and a water chamber. Water pressure in the line applies a force to the diaphragm, causing the diaphragm to deflect to pressurize the air chamber. Pressurized air exerts an operating force on the pressure switch.

THE DRAWINGS

FIG. 1 schematically illustrates a water well system having a pump-operating mechanism constructed according to my invention.

FIG. 2 is an enlarged view showing internal details of a mechanism used in the FIG. 1 system.

DESCRIPTION OF A PREFERRED EMBODIMENT OF THE INVENTION

Figure 1:
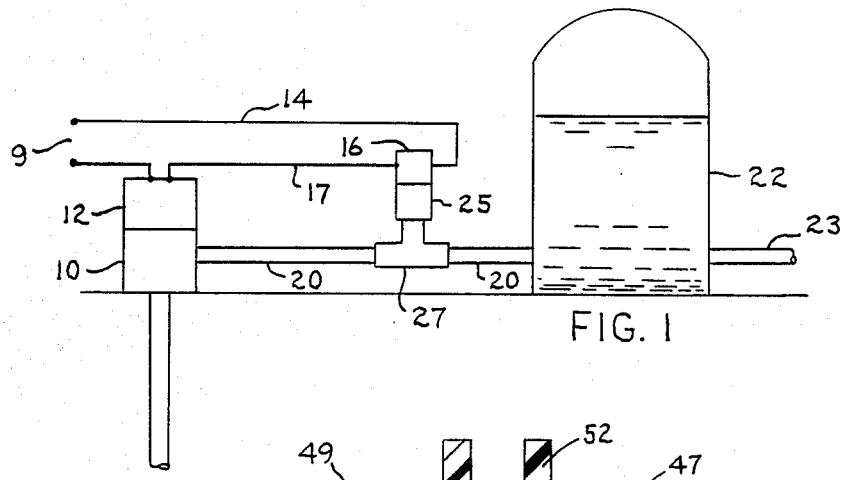

There is shown an outdoor water well system that includes an above-ground pump 10 operated by an electric motor 12. Electric current is supplied to the motor through a circuit that includes electric source 9, electric line 14, pressure switch 16, and electric line 17. Closure of the switch contacts energizes the motor, either directly or through a relay.

A water line 20 leads from pump 10 to an upstanding water tank 22; another line 23 leads from tank 22 to the various outlets (not shown) that make up the system. Line pressure maintains the level in the tank at some elevated value, sufficient for the tank to supply water to line 23 during periods of high water usage.

Figure 2:
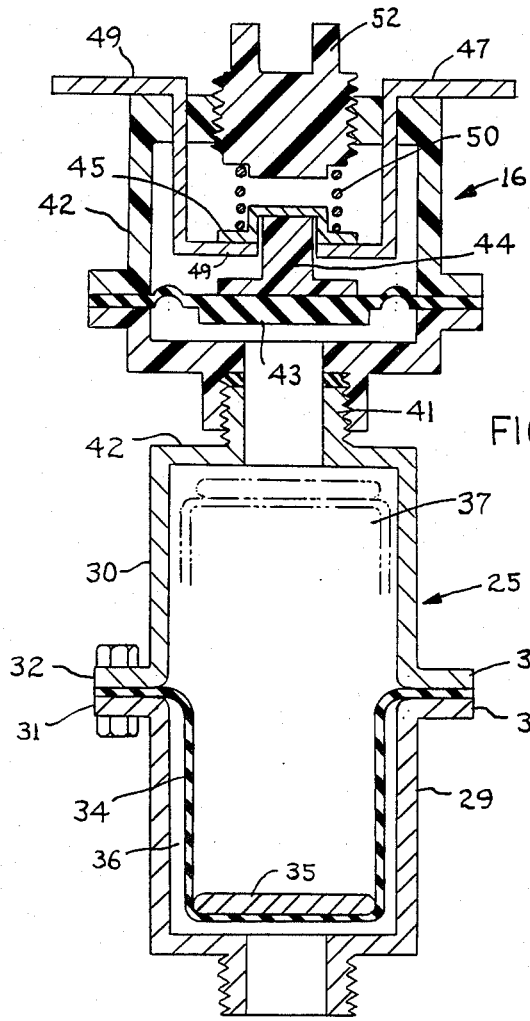

Pressure switch 16 is connected to a housing 25 that is in turn connected to a T-fitting 27 inserted into line 20. FIG. 2 illustrates one way that switch 16 and housing 25 can be constructed.

As seen in FIG. 2, housing 25 comprises two housing sections 29 and 30 having peripheral flanges 31 and 32 designed to exert clamp forces on the peripheral edge area of a thin flexible rubber diaphragm 34. Each housing section, 29 or 30, is a cylindrical cup-shaped structure; the two structures are arranged with their mouth surfaces facing one another to exert the necessary clamp force on the peripheral edge area of diaphragm 34.

Diaphragm 34 acts as a movable partition to subdivide the housing into a water chamber 36 and air chamber 37. FIG. 2 shows two extreme positions of diaphragm 34, namely a de-pressurized position (full line) and a fully pressurized position (dashed lines). Water pressure on the undersized of the diaphragm produces an upstroke of the diaphragm; a small circular plate 35 may be adhered to the upper surface of the diaphragm to promote a piston-like motion of the diaphragm.

A threaded connector tube extends axially downwardly from the lower end wall of housing section 29 for screw-on connection to T-fitting 27 (FIG. 1). Another threaded connector tube 41 extends axially upwardly from end wall 42 of housing section 30 for screw-on connection to pressure switch 16. The threaded connector tube 41 is preferably an integral part of housing section 30.

Pressure switch 16 comprises a two-piece housing structure 42 that mounts a diaphragm 43; an electrically-conductive circular disk 45 is positioned on pin structure 44 to complete a circuit across switch contact blades 47 and 49. Coil spring 50 is trained between disk 45 and a pressure-adjustment screw 52.

During service, water pressure in line 20 is applied to the undersurface of flexible diaphragm 34. The diaphragm moves upwardly to pressurize the air trapped in chamber 37. The pressure in chamber 37 increases according as the chamber 37 volume is decreased (by upward movement of diaphragm 34).

At some point, dependent on the adjusted position of screw 52, the air pressure in chamber 37 forces diaphragm 43 upwardly, to thereby cause disk 45 to interrupt the electric circuit across contact blades 47 and 49. This action de-energizes motor 12 (FIG. 1). Later, when the water line pressure drops diaphragm 34 moves down to increase the chamber 37 volume and thereby decrease the air pressure below diaphragm 43. Spring 50 forces disk 45 to a circuit-closed position.

The assembly is constructed so that chamber 37 experiences a substantial volume change during the upstroke of diaphragm 34. A chamber 37 volume change of about ninety percent can be realized when diaphragm 34 moves upwardly from its full line position to the dashed line position. Such a volume change produces a significant air pressure change commensurate with pressures in commonly used water systems.

Substantial air pressures can be developed without using large housing structures. I estimate that housing structure 25 can have an internal diameter on the order of one inch and an internal axial length on the order to two inches. Diaphragm 34 should be designed to have an appreciable stroke. In the preferred arrangement the two housing sections 29 and 30 are similarly constructed and similarly sized, such that diaphragm 34 is clamped in place at approximately the mid place of the housing; this arrangement enables the diaphragm to have a fairly long stroke, which is desirable to achieve significant air pressure change in a reasonably small size housing.

I claim:

1. In association with an outdoor water well that comprises a motor-driven pump, a water output line leading from the pump, and a pressure tank connected to the output line to maintain a minimum water pressure therein: the improvement comprising means for operating the pump motor whenever the water level in the tank falls below a predetermined level; said operating means comprising a first upright housing connected at its lower end to the water line; a movable partition within the housing subdividing said housing into a lower water chamber communicating with the water line and an upper air chamber; and a motor-control pressure switch communicating with the air chamber, whereby air trapped in the air chamber exerts an operating force on the pressure switch;

said housing comprising two axially-aligned upper and lower cup-shaped housing sections having mouth surfaces facing one another; said movable partition comprising a first flexible diaphragm having a peripheral flange clamped between the mouth surfaces of the upper and lower housing sections; said housing sections being essentially the same size so that the diaphragm flange is at approximately the housing mid plane; said first diaphragm having a hat-shaped cross section depending into the lower housing section when the upper air chamber is depressurized; the water line pressure exerting a force on the diaphragm lower face such that high water line pressures cause said first diaphragm to be deflected upwardly into a hat-shaped cross-section extending upwardly into the upper housing section; said first diaphragm being sized to extend substantially the full axial depth of each housing section in the fully deflected positions of the diaphragm;

said pressure switch comprising a second housing structure (42) located directly above said first housing, and a second deflectable diaphragm (43) mounted in said second housing structure so that the lower face of said second diaphragm is in open communication with the air chamber defined by the upper surface of the first diaphragm; the stroke distance for the first diaphragm being many times the stroke distance of the second diaphragm, whereby significant air pressure changes take place as the first diaphragm moves between its two positions extending, respectively, into the lower and upper housing sections.

* * * * *